US006901227B2

(12) United States Patent
Ziegelmuller et al.

(10) Patent No.: US 6,901,227 B2
(45) Date of Patent: May 31, 2005

(54) SUPPORT BRACKET/BACKUP SHOE ASSEMBLY FOR WEB-CLEANING CARTRIDGE

(75) Inventors: Francisco L. Ziegelmuller, Penfield, NY (US); Carol K. Dunn, Rochester, NY (US); Randall J. Taylor, Bergen, NY (US); Maria B. Carrone, Scottsville, NY (US); George D. Gross, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 833 days.

(21) Appl. No.: 09/738,751

(22) Filed: Dec. 15, 2000

(65) Prior Publication Data

US 2004/0076446 A1 Apr. 22, 2004

(51) Int. Cl.[7] ..... G03G 21/00

(52) U.S. Cl. ..... 399/99; 399/101; 399/343; 399/345; 399/350; 399/351; 399/123

(58) Field of Search ..... 399/98, 99, 101, 399/123, 297, 343, 345, 350, 351; 15/256.51, 256.52

(56) References Cited

U.S. PATENT DOCUMENTS 4,866,483 A 9/1989 Davis et al. ..... 355/299
5,426,485 A * 6/1995 Fujita et al. ..... 399/350
6,453,134 B1 * 9/2002 Ziegelmuller et al. ..... 399/101

OTHER PUBLICATIONS

U.S. patent application Ser. No. Not Yet Assigned, filed Dec. 15, 2000, in the names of Francisco L. Ziegelmuller et al, entitled Web–Cleaning Apparatus for Electrostatic Printer/Copier.

* cited by examiner

*Primary Examiner*—Hoang Ngo

(57) ABSTRACT

A cleaning station for removing particulate material from a moving web in an electrostatic printer/copier includes a customer-replaceable web-cleaning cartridge and a support bracket/backup shoe assembly. The latter serves to support the cleaning cartridge for movement between an operative position in which web-cleaning components of the cartridge exert a substantially uniform pressure on the web, and a service position in which the cartridge is sufficiently spaced from the web to facilitate replacement and/or service. Preferably, a bracket that supports the cleaning cartridge is pivotally connected to a backup shoe that is fixed with respect to the web path and exerts a uniform pressure on the rear surface of the web, opposite that contacted by the cleaning cartridge. A quick disconnect feature enables the cartridge-supporting bracket to be de-coupled from the back-up shoe and removed from the instrument.

10 Claims, 7 Drawing Sheets

SUPPORT BRACKET/BACKUP SHOE ASSEMBLY FOR WEB-CLEANING CARTRIDGE

CROSS REFERENCE TO RELATED PATENT APPLICATIONS

Reference is made to the commonly assigned U.S. Patent No. 6,453,134, issued on Sep. 17, 2002, in the names of Ziegelmuller et al., entitled "WEB-CLEANING APPARATUS FOR ELECTROSTATIC PRINTER/COPIER."

BACKGROUND OF THE INVENTION

1. Field of the Invention

This invention relates in general to improvements in cleaning apparatus of the type used, for example, in electrostatic document printers or copiers to remove residual toner, carrier, dust, lint, paper fibers, and the like, from a moving surface, typically in the form of an endless web. More particularly, it relates to a bracket/backup shoe assembly for precisely and repeatedly positioning a customer-replaceable cleaning cartridge adjacent to a moving web that is to be continuously cleaned by such cartridge.

2. Description Relative to the Prior Art

Many electrophotographic printers/copiers use endless webs for recording and/or transferring images, as well as for conveying image-receiving sheets (typically sheets of paper) between image-transfer and other image-processing stations within the instrument. To assure high quality results, it is necessary to maintain the surfaces of such webs free of particulate contaminates (toner, dust lint paper fibers, etc) that may ultimately transfer to the image-receiver sheet or otherwise degrade the quality of images produced thereon. Heretofore, a variety of web-cleaning devices have been devised and used to satisfy this need. One such device is generally referred to as a "blade cleaner" and, as its name suggests, it comprises one or more elongated flexible blades having an edge positioned to contact a moving web to either scrape or wipe particles from the web, depending on the angle of contact between the blade and the web surface. Different types of blade cleaners, both scrapers and wipers, are disclosed, for example, in U.S. Pat. No. 5,426,485 in which cleaning blades serve to remove particulate material from an endless elastic belt used to convey copy sheets in an electrostatic copier.

In U.S. Pat. No. 4,866,483, a blade-type cleaning station is disclosed for use in a table-top electrostatic printer. Here, a pair of spaced, parallel cleaning blades set to operate in a wiping mode, serves to remove or scavenge residual toner from an endless photoconductive image-recording belt following transfer of a toner image to a copy sheet. As the image-recording belt moves along its endless path, scavenged toner falls into a sump from which it is continuously removed by a rotatably driven auger. The rotating auger, which is located in the bottom of the sump, serves to transport the scavenged toner to a remote receptacle that can be readily removed from the machine and emptied by the operator. In this disclosure, the cleaning station is rigidly mounted on the printer's base frame. To gain access to the cleaning station for servicing, and the like, the entire print engine, including the image-recording belt, is mounted on a pivoting frame for movement towards and away from the cleaning station. As it moves towards the cleaning station, the print engine's image-recording belt pressingly engages the respective edges of the cleaning blades and is thereby positioned to be cleaned by the blades as the belt advances along its endless path. Upon being moved away from the cleaning station, sufficient space is eventually provided to enable the machine operator or service personnel to service the cleaning station, e.g., to vacuum scavenged toner from that portion of the sump directly beneath the cleaning blades, or to replace the cleaning blades themselves.

While the cleaning station disclosed in the above-noted patent affords certain advantages not found in prior devices, it may still be viewed as problematic in certain respects. For example, the rotating auger system used to transport scavenged particles from the blade cleaner to a remote receptacle for removal is a relatively complex and costly component of the machine, one that is subject to eventually fail. Further, since the cleaning station is fixed within the machine frame, service access can only be effected by pivoting the relatively heavy print engine through a large arc away from the cleaning station. This, of course, necessitates a relatively formidable and complex mounting mechanism, one that is capable of handling and counter-balancing the relatively heavy weight of the print engine. Ideally, the print engine should remain stationary, and the cleaning station, like most other image-processing stations, should be movable relative to it. Further, once the print engine has been pivoted to its service position to gain access to the scavenged particle sump for vacuuming, blade replacement, etc., the entire sump is exposed to ambient air, and any air currents in the vicinity of the open sump, as occurs during movement of the print engine, can have the effect of blowing toner, dust, etc. throughout the instrument. Ideally, the scavenged particle sump should be easily removed from the vicinity of the machine frame while scavenged particles are confined therein. Once removed, the sump can then be discarded and replaced with a new sump, or it may be cleaned at a location safely spaced from the machine and then replaced. Further, since there is no hard back-up for the web to resist the pressure applied on the web applied by the cleaning blades, the web is likely to stretch over time, thereby changing the dynamics at the blade edge/web interface.

In the cross-referenced patent application noted above, the subject matter of which is incorporated herein by reference, a customer-replaceable web-cleaning cartridge is disclosed that addresses some of the short-comings noted above. In the embodiment disclosed, an endless web to be cleaned is part of a conveyor system used to transport image-receiver sheets past one or more image-transfer stations in an electrophotographic printer. The web-cleaning cartridge comprises a pair of cleaning blades positioned to operate in a wiping mode to scavenge particles from the web surface, and a sump housing that serves both to support the cleaning blades and to collect and retain particles wiped from the web by the blades. Preferably, the cartridge blades are designed to cooperate with a hard backup "shoe" located on the opposite side of the web surface from that contacted by the blades to produce a uniform wiping pressure across the web width while minimizing any tendency for the web to stretch. It is also preferred that the cleaning cartridge be fabricated so as to be disposable after the sump housing has become filled with particles. Thereafter, the cartridge can be readily replaced with a new cartridge. This replaceability of the cartridge necessitates a reliable mechanism by which each new cartridge can be precisely positioned in contact with the web surface with the cleaning blades exerting a predetermined and uniform pressure on the web across its entire width. Further, such a mechanism should enable the cartridge to be easily moved between its operative position and a service position in which the cartridge blades, seals, lid, etc can be removed, serviced and, if necessary, replaced.

SUMMARY OF THE INVENTION

In view of the foregoing, an object of this invention is to provide an improved web-cleaning apparatus that overcomes the aforementioned disadvantages of the prior art devices.

Another object of this invention is to provide a simple yet reliable apparatus for supporting a web-cleaning cartridge of the type described above for movement between an operative position in which the cartridge is supported with its cleaning blades in contact at uniform pressure with the web, and a service position in which the cartridge is sufficiently displaced from the web to enable cartridge servicing and/or replacement.

Another object of this invention is to provide a simple yet reliable apparatus by which one end of a web-cleaning cartridge can be pivoted away from pressing engagement with a hard backup member that pivotally supports the cartridge and into a service position in which the cartridge can be de-coupled from a supporting bracket.

As will become more apparent from the ensuing detailed description of preferred embodiments, these and other objects of the invention are realized, in accordance with one aspect of the invention, by the provision of a new and improved apparatus for cleaning particulate material from a moving web in an electrostatic printer/copier. Such apparatus comprises: (a) a web-cleaning cartridge having a web-cleaning component adapted to contact a surface of a moving web and to remove particles therefrom; and (b) a support bracket/backup shoe assembly for selectively positioning said web-cleaning cartridge in a web-cleaning position in which said web-cleaning component pressingly engages the web surface. The support bracket/backup shoe assembly comprises: (i) a bracket housing for releasably supporting the web-cleaning cartridge, and (ii) a backup shoe assembly having a hard surface adapted to contact the web surface opposite that contacted by the web-cleaning component and to resist the force exerted by the web-cleaning component of the cartridge. The backup shoe is mounted at a fixed location along the web path, and the bracket housing is pivotally mounted on the backup shoe for movement between an operative position in which the web-cleaning component exerts a substantially uniform pressure on the web, and a service position in which the web-cleaning cartridge is sufficiently spaced from the web to enable the removal of the web-cleaning cartridge from the bracket housing.

According to another aspect of the invention, apparatus is provided for releasably supporting a replaceable web-cleaning cartridge for movement between an operative position in which one or more web-cleaning elements of the cartridge contact a moving web surface and act to remove particulate material from such surface, and a service position in which the cartridge is sufficiently spaced from the web to facilitate service and/or replacement of the cartridge. Such apparatus comprises a bracket/backup shoe assembly including: (a) a bracket sub-assembly including a frame defining a cavity for releasably receiving and supporting the web-cleaning cartridge; (b) a backup shoe sub-assembly adapted to contact a web surface opposite that contacted by the cleaning element(s) of the web-cleaning cartridge to provide a resistance to pressure exerted on the web by the cleaning element(s); (c) a first mount for supporting the backup shoe sub-assembly at a fixed location adjacent the path of movement of the web; (d) a second mount for pivotally connecting an end of the bracket sub-assembly to the backup shoe sub-assembly to enable the cartridge to move between its operative and service positions; and (e) a latch for releasably latching the two sub-assemblies in a position in which the cartridge is in its operative position. Preferably, the pivotal mounting between the respective bracket and backup shoe sub-assemblies are effected by a slot/tab assembly which enables the cartridge-supporting bracket to be physically de-coupled from the shoe assembly, thereby facilitating cartridge service and/or replacement, or a replacement of the endless web.

The invention and its various advantages will be better understood from the ensuing detailed description of preferred embodiments, reference being made to the accompanying drawings in which like reference characters denote like parts.

BRIEF DESCRIPTION OF THE DRAWINGS

The invention and its objects and advantages will become apparent upon reading the following detailed description and upon reference to the drawings, in which.

DETAILED DESCRIPTION OF THE PREFERRED EMBODIMENTS

While the present invention will be hereinafter described in connection with a preferred embodiment thereof, it will be understood that it is not intended to limit the invention to that embodiment. On the contrary, it is intended to cover all alternatives, modifications and equivalents as may be included within the spirit and scope of the invention, as defined by the appended claims.

Figure 1:
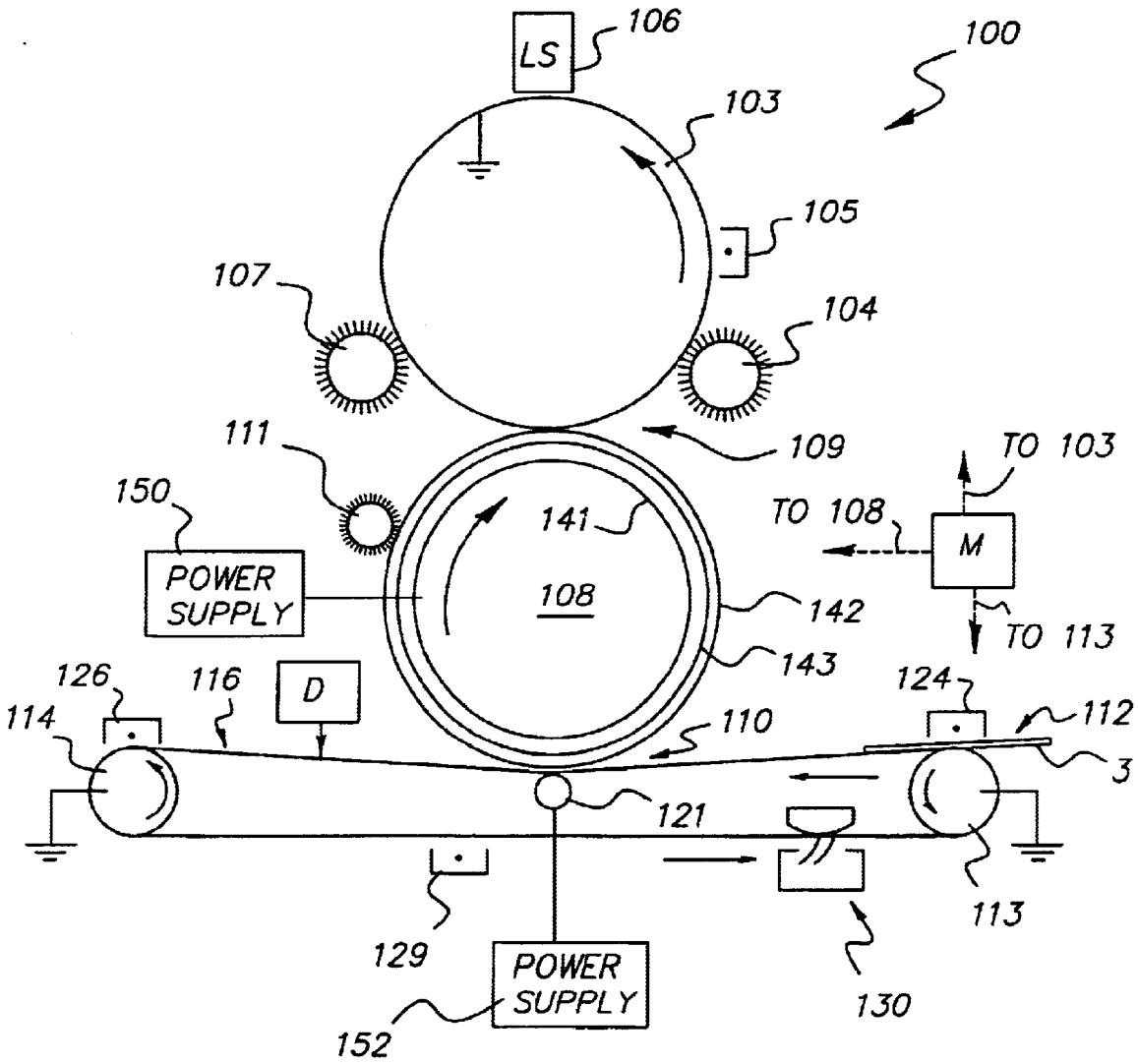
FIG. 1 is a schematic illustration of an electrostatic document printer in which the invention is useful and is shown as being embodied.

Referring now to FIG. 1, a conventional electrophotographic document printer 100 in which the invention has utility is shown to comprise a primary image-forming member 103, for example, a rotatably driven conductive drum having an outer surface of a photoconductive material. One or more transferable toner images are formed on the photoconductive surface of drum 103 by first uniformly charging the surface with electrostatic charge provided by a corona charger 105 or the like. The uniformly charged surface is then imagewise exposed to actinic radiation provided, for example, by a laser scanner 106, thereby selectively discharging the charged surface and leaving behind a latent charge image. Finally, the latent charge image is rendered visible (developed) by applying electroscopic toner particles using a magnetic brush applicator 107, or the like. In some printers of this type, a series of toned process control patches (images) are also formed on the surface of the image-recording element, such patches being located in the interframe region between successive image frames.

The above-noted toner images and toned process control patches are then transferred to an intermediate image-transfer member 108 at a transfer nip 109. Any residual toner on the image-recording member 103 is removed by a cleaning brush 104 prior to recycling the image-recording member through the image-forming process. The image-transfer member may comprise, for example, an electrically-conductive drum 141 having a compliant blanket 143 with a relatively hard overcoat 142. The conductive drum is electrically biased by a power supply 150. The toner images transferred onto intermediate image-transfer member are then re-transferred to an image-receiver sheet S at a transfer nip 110 formed by a relatively small transfer roller 121 and an endless sheet-transport web 116 made of a dielectric material such as a polymer compound. Residual toner on member 108 is removed by a cleaning brush 111.

The image-receiver sheets S are presented to the endless sheet-transport web 116 at a feed station 112. Web 116 is trained around a pair of rollers 113 and 114, and a motor M serves to drive roller 113 in the direction indicated by the arrow. Motor M also serves to rotatably drive the image-recording and image-transfer drums. The image-receiver sheets (e.g., paper or plastic) attach to web 116 at a corona charging station 124 which operates to charge the top surface of the sheet so that it becomes electrostatically attracted to the web. The grounded rollers 113 and 114 serve to charge to the rear side of the web. Toner images are electrostatically attracted, and thereby transferred, to the image-receiver sheets by a suitable electrical bias applied to transfer roller 121 by power supply 152. A corona charger 126 serves to detack the image-receiver sheets as they wrap around transport roll 114, thereby freeing the sheets for further transport to a toner fusing station, not shown. Note, being outside the image frame areas on the image-recording drum, any toned process-control patches transferred to the image-transfer member 108 will re-transfer directly to the transport web in the region between successive image-receiver sheets. These toned patches must be removed from the web before receiving a new image-transfer sheet. Otherwise, the toner from these patches will transfer to the rear side of the image-receiver sheets.

Figure 2:
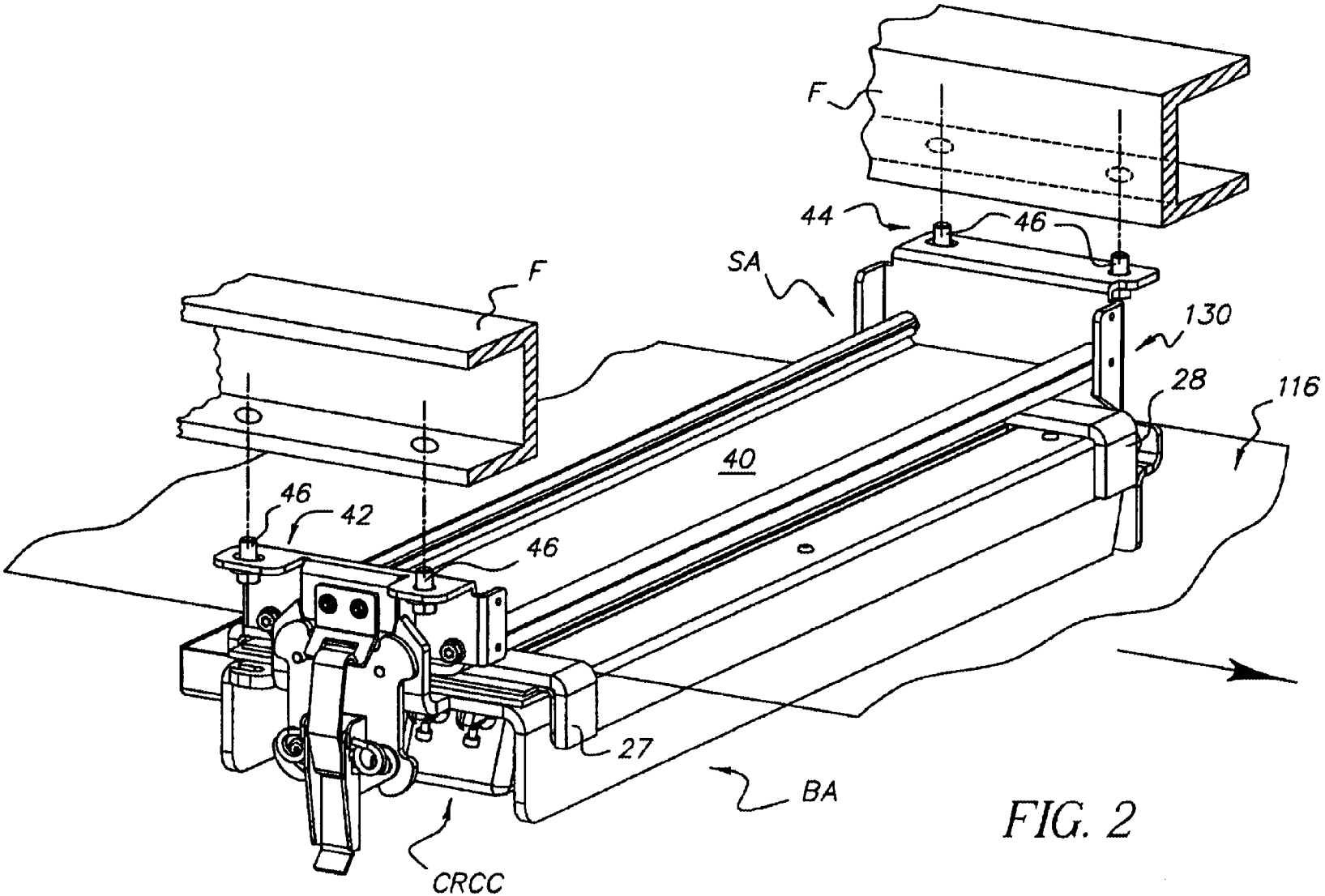
FIG. 2 is a perspective view of a preferred embodiment of the apparatus of the invention shown as supporting a web-cleaning cartridge in an operative position.
Figure 3:
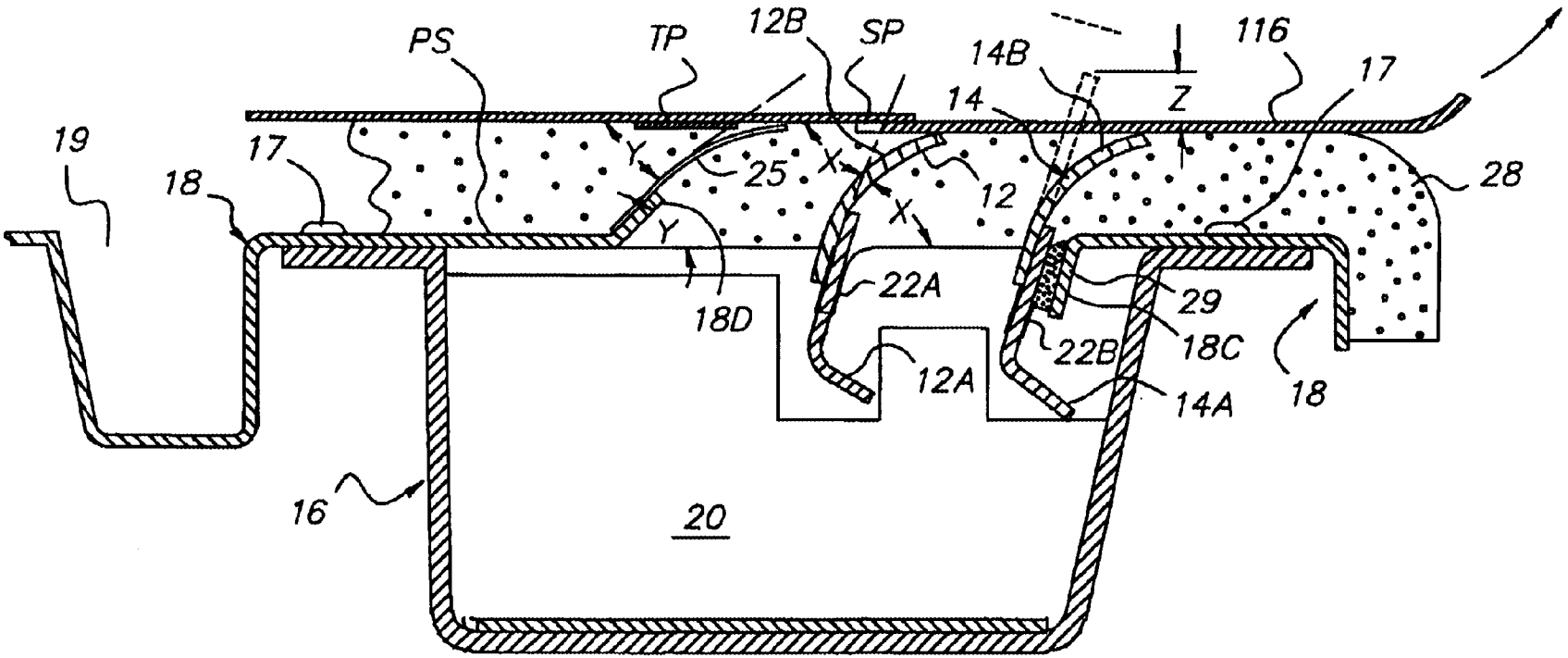
FIG. 3 is a perspective view of a web-cleaning cartridge and two major components of the apparatus of the invention.
Figure 4:
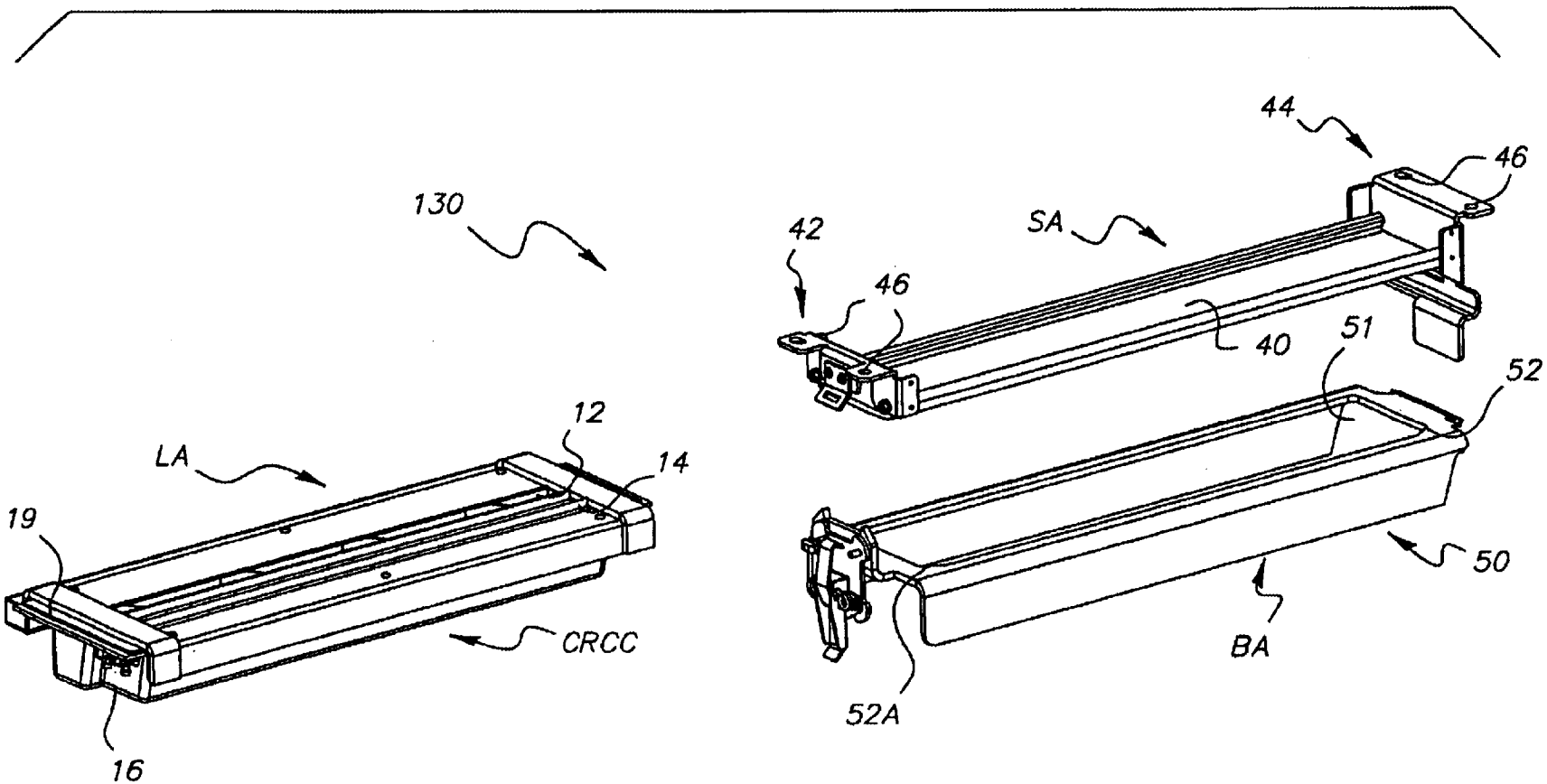
FIG. 4 is an enlarged perspective view of a web-cleaning cartridge with which the apparatus of the invention is used.

Now in accordance with the present invention, a web-cleaning apparatus 130 is provided for removing not only the random toner particles, dust, paper debris, etc., that may accumulate on the outer surface sheet of the transport web 116 during repeated use of the printing machine described above, but also any relatively heavy deposits of toner that may be transferred to the web as the result of forming the aforementioned process-control patches on the image-recording drum, paper jams, misregistration of the toner image with the image-receiver sheets, etc. Referring to FIGS. 2–4, and particularly to FIG. 3, a preferred web-cleaning apparatus 130 is shown as comprising two major components, namely, a customer-replaceable cleaner cartridge CRCC that provides a web-cleaning function and a support bracket/back-up shoe (SBBS) assembly that serves to properly position the cartridge with respect to web 116. As shown in FIG. 3, the SBBS assembly comprises bracket sub-assembly BA for releasably supporting the CRCC, and a back-up shoe subassembly SA for providing a hard resistance to the pressure applied on the web by the CRCC. As described below, bracket assembly BA is pivotally mounted to one end of the back-up shoe assembly to enable the cleaning cartridge to be moved between an operative position (shown in FIGS. 2 and 8) in which its cleaning components engage web 116 and press against the backup shoe, and a service position (shown in FIG. 5) in which the cartridge is sufficiently spaced from the web to enable it to be removed from the support bracket BA for servicing and/or replacement.

As better described in the aforementioned cross-referenced U.S. Pat. No. 6,453,134, issued on Sep. 17, 2002, in the names of Ziegelmuller et al., the contents of which being hereby incorporated by reference herein, the CRCC comprises two or more cleaning blades 12, 14 (shown in FIG. 4) that are adapted to contact and wipe particles from the outer surface of the moving web 116; a sump housing 16 for supporting the cleaning blades and for receiving and storing particles wiped or scavenged from the outer surface of web 116 by the cleaning blades; and a multi-purpose lid 18 that releasably attaches to the top of the sump housing and serves not only to prevent scavenged particles from escaping through the top of the sump housing, but also to clean the edges of the web as it passes by, and to store particles deflected from the web by a seal blade 20 located on the lid upstream of the cleaning blades. The top surface of the lid is shaped to define an auxiliary external sump 19 which is adapted to collect and contain any particulate material that may get deflected upstream of the intended web-cleaning. A pair of foam seals 27, 28 attached to lid 18 at both sides of the sump housing, serve both to minimize any leakage of scavenged particles out of the sides of the sump during use of the cleaning apparatus and to wipe particles from the sides of the web. Sump housing 16 comprises a generally rectangular structure that defines a reservoir R surrounded by four flanges 16F (two of which being shown in FIG. 4).

Figure 6:
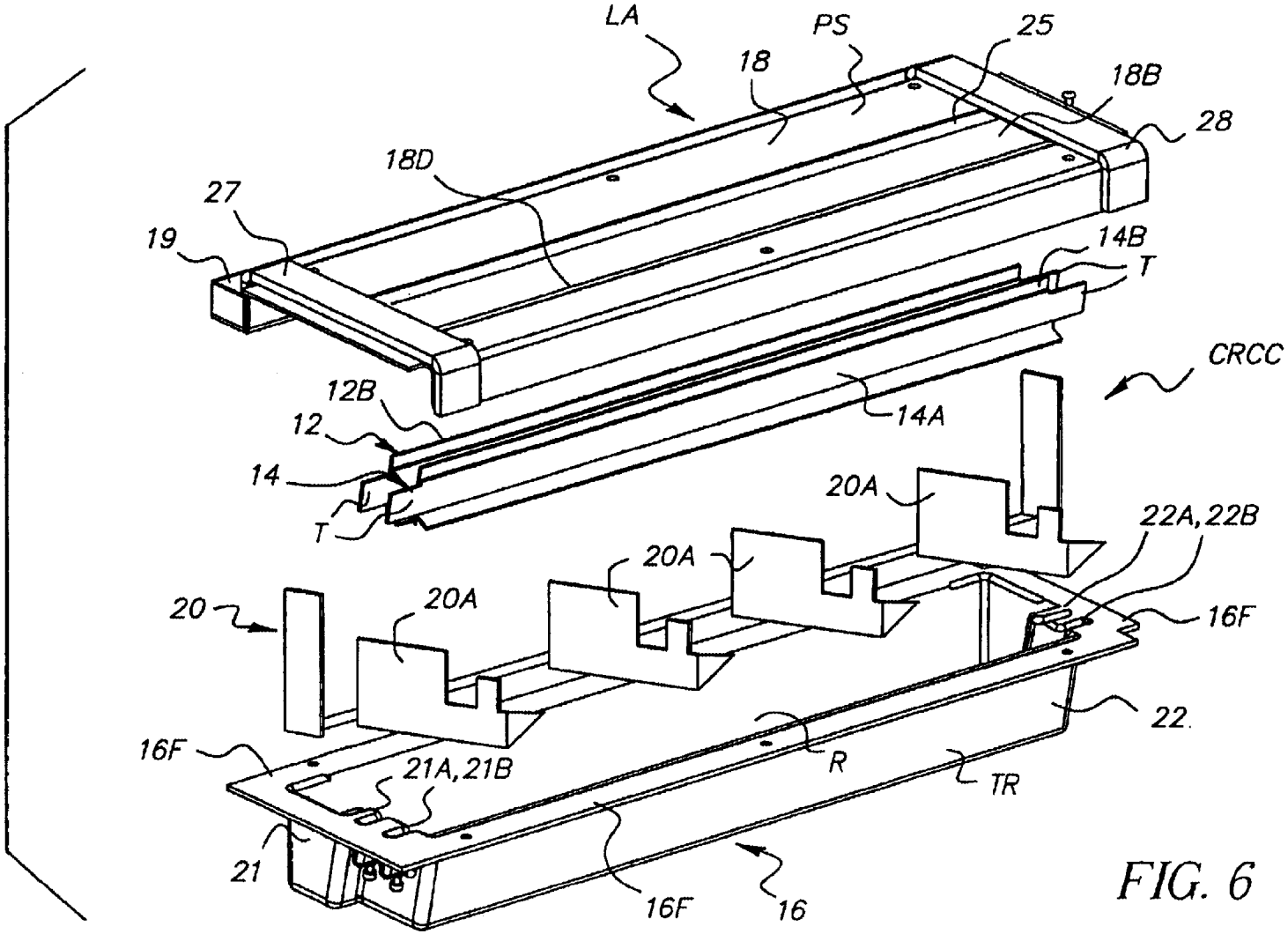
FIG. 6 is an exploded view of the cartridge-supporting bracket assembly shown in FIG. 3.

Referring to FIG. 6A, cartridge-supporting bracket assembly BA of the SBBS assembly comprises a frame member 50 having a planar upper surface 50A with a rectangular opening 52 formed therein. Frame 50 further comprises a pair of downwardly-depending legs 54, 56 which facilitate removal of a cleaning cartridge from the frame opening 52, as explained below. Opening 52 is shaped to receive the rectangular sump housing 16, and the peripheral area of the frame that surrounds the opening serves to support the cartridge by the four flanges 16F arranged about the sump housing periphery. Preferably, a pair of slanted edge features 50B on frame member 50 cooperates with similarly shaped features on the sump housing to assure that the CRCC is received in the proper orientation, i.e., so that the cleaning blades operate in a wiping mode. Thus, it will be appreciated that the CRCC is installed in the bracket assembly by simply dropping the sump housing 16 into opening 52 until flanges 16F rest upon surface 50A. Leg members 54, 56 extend substantially normal to surface 50A and are of a length slightly shorter than the height of the sump housing 16. Thus, in the event the support bracket assembly BA is removed from the instrument (as explained below) and placed on a flat table with legs 54, 56 extending downwardly, the CRCC will pop out slightly from opening 52, thereby facilitating removal of the CRCC for servicing or replacement.

In addition to the above-described features, the cartridge-supporting bracket assembly BA further comprises a T-shaped mounting feature 58 (shown best in FIG. 6B) that extending outwardly from one end of member 50, and a latch assembly L mounted on the opposite end of member 50. Mounting feature 58 comprises a pair of opposing tabs 58A, 58B, one being slightly longer than the other. These tabs engage a slot formed in a flange supported by the backup shoe assembly and, as discussed in more detail below, form part of a quick-disconnect pivotal mount by which the bracket assembly BA is releasably and pivotally supported by the backup shoe assembly. Latch assembly L comprises a pivotally mounted tension latch 60 that is suitably positioned on housing 50 by an upwardly extending flange 61 and an intermediate mounting plate 62. The latch assembly cooperates with a latch keeper 77 carried by a front mounting bracket on the shoe assembly and serves to precisely locate the bracket assembly in its operative position relative to the shoe assembly. Preferably, bracket member 50 is made of high strength steel with sufficient rigidity and straightness (e.g., aluminum) to prevent buckling, twisting or permanent deformation due to its weight, the weight of a fully loaded cartridge or due to the latching load or the cleaner load as it engages the transport web and the backup shoe, as explained below.

Figure 5:
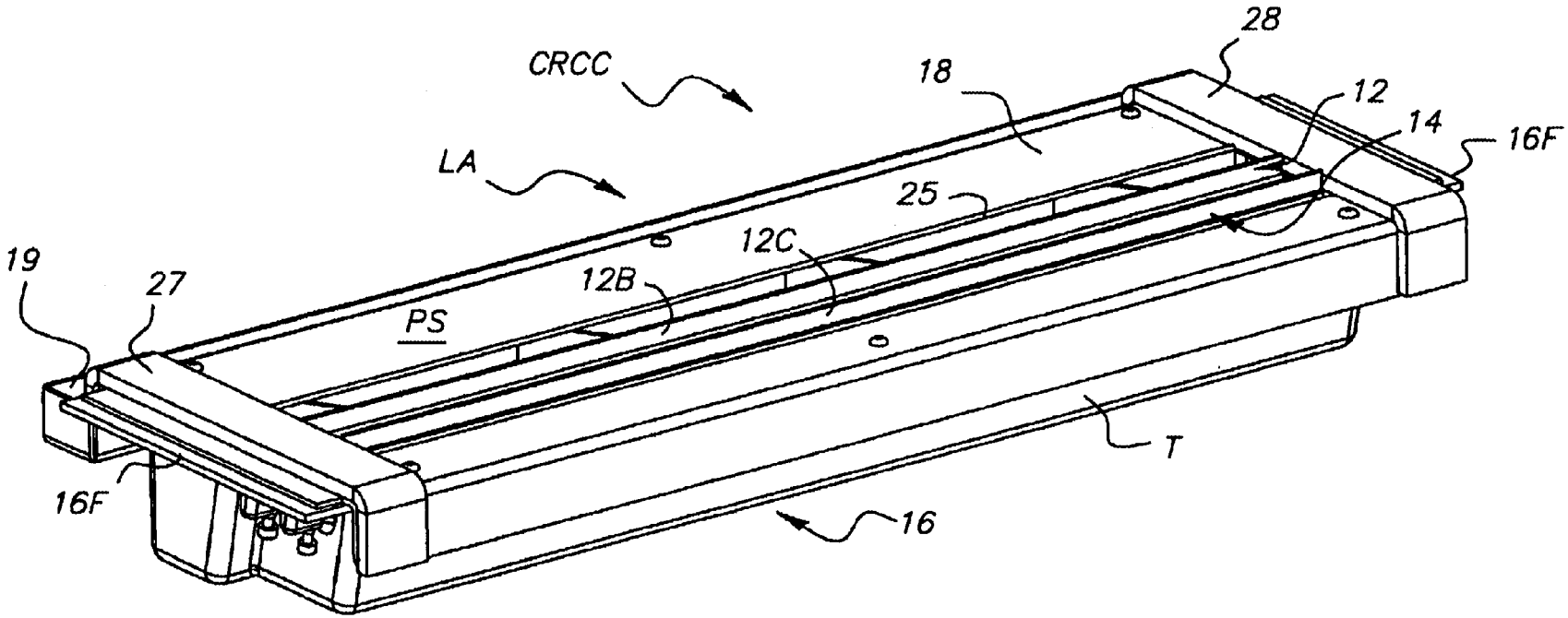
FIG. 5 is a perspective view illustrating the pivotal relationship between the cartridge-supporting bracket and backup shoe subassemblies of the apparatus of the invention.
Figure 7C:
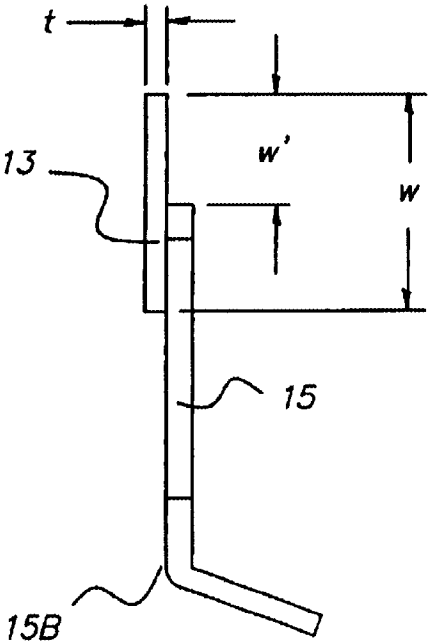
FIG. 7C is a side view illustrating the cartridge-supporting bracket and backup shoe assemblies shown in FIG. 3 in operative positions with respect to each other.
Figure 7A:
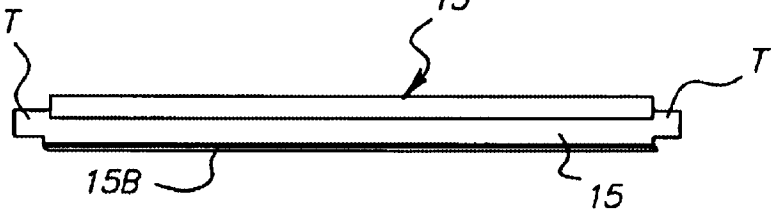
FIG. 7A is an exploded view of the backup shoe assembly shown in FIG. 3.
Figure 7B:
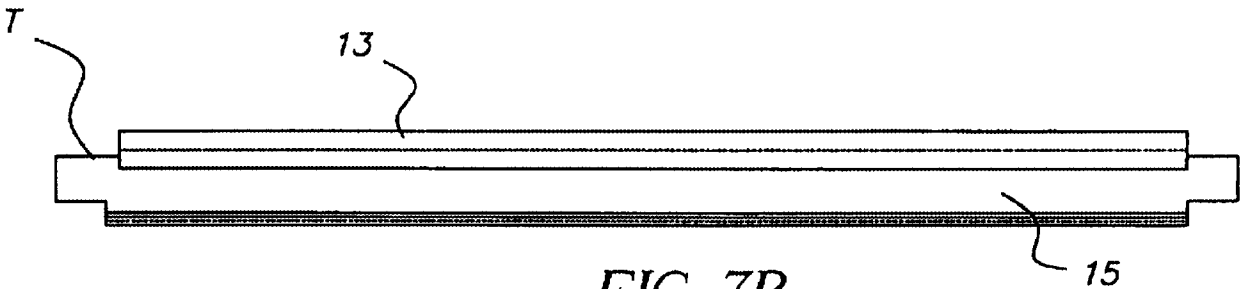
FIG. 7B is an enlarged perspective view of a detail of the FIG. 7A apparatus.

Referring to FIG. 7A, the backup shoe assembly SA comprises a slightly rounded plate or "shoe" 70 having a conductive and wear-resistant surface to avoid charge buildup. Shoe 70 has a large radius to provide a hard backing to both cleaning blades of the cleaning cartridge. Preferably, the shoe is made of aluminum or steel and has a radius of 500 mm at the surface in contact with the transport web. The shoe is plated with a conductive and high wear resistant material, preferably chrome or nickel, but it may also be used with Martin hard coating or anodized hard coating, even though the latter is not conductive. The shoe, when mounted on the web frame, will generate a wrap with the transport web when the web tension is on. The blades may contact the web either within the wrap or slightly outside the wrap as long as it generates enough force to clean residual toner waste and other contaminants from the web. A passive grounded brush can be mounted to the shoe assembly inside the web frame to control triboelectric charge build up. Front and rear mounting brackets 72, 74, rigidly connected to opposite ends of the shoe, serve to rigidly connect the backup shoe assembly to the web-transport frame F, whereby the shoe is located at a fixed position with respect to the web path (see FIG. 2). As best shown in FIG. 7B, rear mounting bracket 74 is provided with a downwardly extending flange 75 in which a slot 75A adapted to receive the opposing tabs 58A, 58B of the T-shaped mounting feature 58 extending from the bracket assembly. Thus, the cartridge-supporting bracket assembly is pivotally mounted to the shoe assembly by inserting first the longer tab 58B while holding the bracket assembly at a slight angle relative to the face of the rear mounting bracket 74 and shifting the bracket assembly BA to the leftmost part of the slot (as viewed in the drawings) and then rotating it to the right until the short tab 58A is inside the slot. Once both tabs are inside the slot 75A, bracket assembly BA is shifted to the right to prevent it from coming out of the slot. When so positioned, bracket assembly BA can be pivoted between an operative position, as shown in FIG. 8, and a service position, as shown in FIG. 5. The downward movement of the bracket assembly can be limited by a cable or chain C connected between the front ends of assemblies BA and SA, or, alternatively, by providing an extension tab 78 on flange 75 that is positioned to engage an edge 54A of the bracket assembly as this assembly pivots towards its service position and thereby provides a rest or stop to the further movement of the bracket assembly BA. Preferably, the bracket assembly BA and the front mounting bracket 72 of the backup assembly have features to allow quick disconnect of the chain or cable to enable removal of the bracket assembly from the instrument.

Back-up shoe assembly SA further comprises a front mounting bracket 72 with features to allow precise positioning of the CRCC with respect to the shoe and a latching function with respect to the bracket assembly BA, and a rear bracket portion 74 having a slot feature that provides precise positioning of the cleaner with respect to the shoe.

The shoe assembly is designed to generate a uniform gap X between the top surface 50A of the sump bracket and the bottom-most part of the shoe, as shown in FIG. 8. By reducing variability in the gap, any variability in blade engagement can be reduced. Both the front and rear mounting brackets 72, 74 provide mounting interfaces for the bracket assembly BA. As noted above, the front mounting bracket 72 supports a latch keeper 77 that is engaged by a hook on the tension latch of the latch assembly to maintain the web-cleaning cartridge in an operative position relative to the backup shoe and the intervening web.

While the invention has been described in detail with reference to a presently preferred embodiment, it will be appreciated that variations can be effected without departing from the spirit and scope of the invention.

Parts List

100 document printer
103 image-forming member
104 cleaning brush
105 primary corona charger
106 laser scanner
107 magnetic brush applicator
108 image-transfer member
109 image-transfer nip
110 second image-transfer nip
111 cleaning brush
112 sheet-feed station
113, 114 web-transport rollers
116 sheet-transport web
121 transfer roller
124 corona charger
126 detack charger
126 conditioning charger
129 conditioning charger
130 web-cleaning apparatus
141 electrically-conductive drum
142 hard overcoat
143 compliant blanket
150, 152 power supplies
12,14 cleaning blades
16 sump housing
16F flanges
18 lid member
19 external sump
20 seal blade
27, 28 foam seals
50 frame member
50A frame member upper surface
50B slanted edge feature
52 opening
54, 56 legs
54A edge on leg 54
58 mounting feature
58A, 58B tabs
60 tension latch
61 flange
62 intermediate mounting plate
70 shoe
72, 74 front and rear mounting brackets
75 flange
75A slot
76 mounting pins
77 latch keeper
78 extension tab C cable
D densitometer
F frame
L latch assembly
M motor
R reservoir
S image-receiver sheets
X gap
BA bracket assembly
SA backup shoe assembly
CRCC customer-replaceable cleaning cartridge
SBBS support bracket/backup shoe

What is claimed is:

1. Apparatus for cleaning particulate material from a moving web in an electrostatic printer/copier comprising:

(a) a web-cleaning cartridge having a web-cleaning component adapted to contact a surface of a moving web and to remove particles therefrom; and (b) a support bracket/backup shoe assembly for selectively positioning said web-cleaning cartridge in a web-cleaning position in which said web-cleaning component pressingly engages said surface, said support bracket/backup shoe assembly comprising (i) a bracket housing for releasably supporting said web-cleaning cartridge, and (ii) a backup shoe assembly having a hard surface adapted to contact the web surface opposite that contacted by said web-cleaning component and to resist the force exerted by said web-cleaning component, said backup shoe being mounted at a fixed location along said path, and said bracket housing being pivotally mounted on said backup shoe for movement between an operative position in which said web-cleaning component exerts a substantially uniform pressure on said web, and a service position in which said web-cleaning cartridge is sufficiently spaced from the web to enable the removal of said web-cleaning cartridge from said bracket housing.

2. The apparatus as defined by claim 1 wherein said bracket housing defines a cavity for receiving said web-cleaning cartridge, said cavity having features that cooperate with features on said web-cleaning cartridge to assure a desired orientation of said web-cleaning cartridge in said cavity.

3. The apparatus as defined by claim 1 wherein said hard surface comprises a wear-resistant and electrically conductive plate.

4. The apparatus as defined by claim 1 wherein backup shoe assembly comprises a flange member having a slot formed therein for releasably receiving a mounting feature on said bracket housing that provides a pivotal connection between said bracket member and said backup shoe assembly.

5. The apparatus as defined by claim 4 further comprising means for limiting the pivotal movement between said bracket housing and said backup shoe assembly.

6. The apparatus as defined by claim 4 wherein said mounting feature is adapted to be readily removed from said slot to enable said bracket housing and a web-cleaning cartridge supported thereby to be de-coupled from said backup shoe assembly.

7. Apparatus for releasably supporting a replaceable web-cleaning cartridge in a web-utilization device for movement between an operative position in which one or more web-cleaning elements of said cartridge contact a moving web surface and act to remove particulate material from said surface, and a service position in which the cartridge is sufficiently spaced from said web surface to facilitate service and/or replacement of the cartridge, said apparatus comprising:

(a) a cartridge-support bracket/backup shoe assembly including (a) a bracket sub-assembly having a frame defining a cavity for releasably receiving and supporting a web-cleaning cartridge;

(b) a backup shoe sub-assembly adapted having a hard surface to contact a web surface opposite that contacted by the cleaning element(s) of the web-cleaning cartridge to provide a resistance to pressure exerted on the web by the clean element(s);

(c) a first mount for supporting the backup shoe sub-assembly at a fixed location adjacent the path of movement of the web; and (d) a second mount for pivotally connecting an end of the bracket sub-assembly to the backup shoe sub-assembly to enable the cartridge to move between its operative and service positions; and (e) a latch for releasably latching the two sub-assemblies in a position in which the cartridge is in its operative position.

8. The apparatus as defined by claim 7 wherein said cavity has features that cooperate with features on said web-cleaning cartridge to assure a desired orientation of said web-cleaning cartridge in said cavity.

9. The apparatus as defined by claim 7 wherein said hard surface comprises a wear-resistant and electrically conductive plate.

10. The apparatus as defined by claim 7 wherein said second mount comprises a slot/tab assembly which enables the cartridge-supporting bracket to be physically de-coupled from the shoe assembly, thereby facilitating cartridge or web service and/or replacement.

* * * * *